US008418492B2

(12) United States Patent
Cieslik et al.

(10) Patent No.: US 8,418,492 B2
(45) Date of Patent: Apr. 16, 2013

(54) CONDENSER FOR A REFRIGERATOR

(75) Inventors: Detlef Cieslik, Giengen (DE); Jochen Härlen, Königsbronn (DE); Michaela Malisi, Heidenheim (DE); Berthold Pflomm, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 961 days.

(21) Appl. No.: 12/519,826

(22) PCT Filed: Nov. 22, 2007

(86) PCT No.: PCT/EP2007/062712
§ 371 (c)(1),
(2), (4) Date: Jun. 29, 2009

(87) PCT Pub. No.: WO2008/077698
PCT Pub. Date: Jul. 3, 2008

(65) Prior Publication Data
US 2010/0037645 A1 Feb. 18, 2010

(30) Foreign Application Priority Data
Dec. 22, 2006 (DE) ..... 10 2006 061 084

(51) Int. Cl.
*F25B 47/00* (2006.01)
*F25D 21/14* (2006.01)

(52) U.S. Cl.
USPC ..... 62/277; 62/285; 62/288; 62/291

(58) Field of Classification Search ..... 62/277, 62/279, 285, 288, 289, 291; 165/67
See application file for complete search history.

(56) References Cited

U.S. PATENT DOCUMENTS

| | | | | |
|---|---|---|---|---|
| 2,375,851 | A * | 5/1945 | Kalischer | 62/289 |
| 3,422,884 | A * | 1/1969 | Otten | 165/67 |
| 4,018,215 | A * | 4/1977 | Pei | 126/655 |
| 4,173,995 | A * | 11/1979 | Beck | 165/51 |
| 4,766,737 | A * | 8/1988 | Baxter, II | 62/279 |
| 5,502,983 | A * | 4/1996 | Dasher | 62/454 |
| 2001/0040021 | A1 * | 11/2001 | Avequin et al. | 165/67 |
| 2006/0108107 | A1 | 5/2006 | Naukkarinen | |
| 2007/0000273 | A1 * | 1/2007 | Sanders | 62/285 |

FOREIGN PATENT DOCUMENTS

| | | | |
|---|---|---|---|
| JP | 719713 | A | 1/1995 |
| JP | 8278076 | A | 10/1996 |
| JP | 10019449 | A | 1/1998 |
| JP | 2000180028 | A | 6/2000 |
| JP | 2001153535 | A * | 6/2001 |

* cited by examiner

*Primary Examiner* — Ljiljana Ciric
*Assistant Examiner* — Alexis Cox
(74) *Attorney, Agent, or Firm* — James E. Howard; Andre Pallapies

(57) ABSTRACT

A condenser assembly for a refrigerator includes a condenser arranged in a frame. The condenser is configured for a flow of a refrigerant therethrough. The frame has at least one evaporation tray that is arranged above the condenser and one evaporation tray that is arranged below the condenser.

22 Claims, 3 Drawing Sheets

CONDENSER FOR A REFRIGERATOR

BACKGROUND OF THE INVENTION

The present invention relates to a condenser module, in particular for a household refrigeration appliance.

In the case of a customary household refrigeration appliance, a compressor for the refrigerant circulating in the refrigeration appliance is accommodated in a recess built into a lower rear area of its housing. A condenser is mounted on a rear wall of the housing. If the refrigeration appliance is set up in a dwelling, this rear wall, together with a building or furniture unit wall, delimits a flue in which air warmed by the condenser rapidly rises, as a result of which cool fresh air flows back into the compressor recess. On the one hand this fresh air cools the compressor, and on the other it contributes to the evaporation of condensate directed from the interior of the refrigeration appliance and collected in a tray mounted on the compressor.

Modern, compact compressors have a high power density, and as a result of improved heat insulation of appliances, their running times are shorter compared with appliances of earlier construction. Although the efficiency of the appliances is improved as a result of these measures, the problem arises that the efficiency of the cooling and of the condensate evaporation suffers, as the heating of the condenser and the airflow through the evaporator chamber thereby come into effect in each case with a delay, after actuation of the compressor. Thus at the beginning of each operating period of the compressor, a phase occurs during which the compressor is inefficiently cooled and the condensate heated by it does not evaporate due to lack of airflow, or cannot be efficiently drawn off from the compressor recess.

In order to save on the space required by a rear wall condenser and to achieve efficient cooling of the compressor and removal of water vapor from the compressor recess, it has been proposed that the condenser be accommodated in compact configuration in the recess and the compressor and condenser cooled with the aid of a ventilator. Even with such a construction, however, it has proved difficult to achieve an adequate evaporation rate for the condensate, especially when this arises in large quantities as a result of the frequent opening of the door, or the storage of moist items for refrigeration. In order to cater for such peaks in the formation of condensate, large evaporation trays are customarily required, accommodation of which in the compressor recess is to the detriment of the usable volume of the refrigeration appliance.

BRIEF SUMMARY OF THE INVENTION

The object of the present invention is to create a compact condenser module which achieves rapid evaporation of the condensate with low energy consumption.

The object is achieved by means of a condenser module for a refrigeration appliance with a condenser arranged in a frame, through which refrigerant can flow, where the frame comprises at least one evaporation tray arranged over the condenser and one evaporation tray arranged under the condenser: In that the evaporation trays delimit a space occupied by the condenser at the top and the bottom, on the one hand the upper tray is efficiently heated by the heat given off by the condenser by means of convection, and on the other hand the surface of the water contained in the lower tray is exposed to direct contact with an airflow through the condenser, which promotes evaporation in the lower tray even in the case of low temperatures.

The upper evaporation tray expediently has an overflow via which the water moves from the upper into the lower evaporation tray.

In order to conduct a stream of air through the condenser compartment without loss, the frame expediently has a side wall extending between the two trays.

If a flow path of the water runs from the overflow into the lower tray via a surface of a side wall facing the condenser, water flowing to the lower tray on this side wall can also efficiently evaporate.

A drip edge lying above the lower evaporation tray is preferably embodied in the flow path on the side wall. The drip edge prevents water flowing over it downward on the side wall, so that water that has passed the overflow then also reliably passes into the lower tray if the side wall itself does not terminate in or over the lower tray. This simplifies in particular the construction of the condenser module.

In order further to improve the evaporation performance of the trays, the condenser is preferably connected in series with a refrigerant line passing through one of the evaporation trays, preferably the lower one.

An impeller of a fan, which drives a stream of air through the condenser module, is preferably arranged in an opening of a front wall of the stand. The front wall prevents air flowing back around the impeller to its upstream side, and thus guarantees high air throughput through the condenser module with low fan power.

A wire tube condenser is preferably used as the condenser.

In order to achieve a compact structure of the condenser, this comprises a plurality of plate-type heat exchanger elements connected in series, preferably in a package-like arrangement.

In order to stabilize the arrangement of the heat exchanger elements, at least one stabilization element with a plurality of grooves is preferably provided, where in each case one edge of one of the heat exchanger elements engages in one of the grooves of the stabilization element.

The stabilization element is preferably embodied in the form of a column, with a rear face touching a side wall of the frame or a recess of the refrigeration appliance accommodating the condenser module. The stabilization element can thus fulfill an additional function, specifically that of concentrating the stream of air circulating through the condenser module in the interior of the condenser module, and preventing air flowing past the side of the condenser essentially without being heated.

A particularly compact assembly results if the stabilization element has pairs of grooves lying opposite each other and at the same height, where sections of piping of the same plate-type heat exchanger element engage in the two grooves of each pair.

Two stabilization elements are preferably provided, which lie opposite each other on opposite sides of the condenser.

BRIEF DESCRIPTION OF THE DRAWINGS

Further features and advantages of the invention will be apparent from the following description of exemplary embodiments with reference to the attached figures, in which.

DETAILED DESCRIPTION OF THE PRESENT INVENTION

Figure 1:
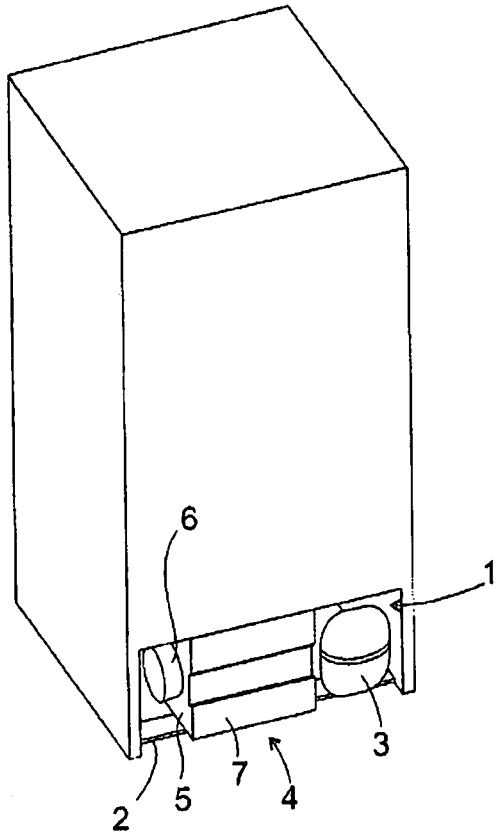
FIG. 1 shows a three-dimensional view of an inventive refrigeration appliance, seen from the rear of its housing.

FIG. 1 shows a rear view of a household refrigeration appliance, such as a refrigerator or a freezer. In the plinth (base or platform) of the appliance is located a recess 1, open toward the observer, through which extends a cross member 2 fixed to the side walls of the housing. On this cross member are mounted a compressor 3 and a condenser housing 4. On a side facing away from the compressor 3, the condenser housing 4 is sealed off by a front wall 5 which is closed except for a through-aperture on which is arranged a fan 6. On one side, the front wall 5 tightly abuts a side wall 7 of the housing 4; on the other side an opposite edge of the front wall 5 touches a vertical insulating wall (not visible in the figure) between the recess 1 and the internal compartment of the refrigeration appliance which. are mounted a compressor 3 and a condenser housing 4. On a side facing away from the compressor 3, the condenser housing 4 is sealed off by a front wall 5 which is closed except for a through-aperture on which is arranged a fan 6. On one side, the front wall 5 tightly abuts a rear wall 7 of the housing 4; on the other side an opposite edge of the front wall 5 touches a vertical insulating wall (not visible in the figure) between the recess 1 and the internal compartment of the refrigeration appliance which.

Figure 2:
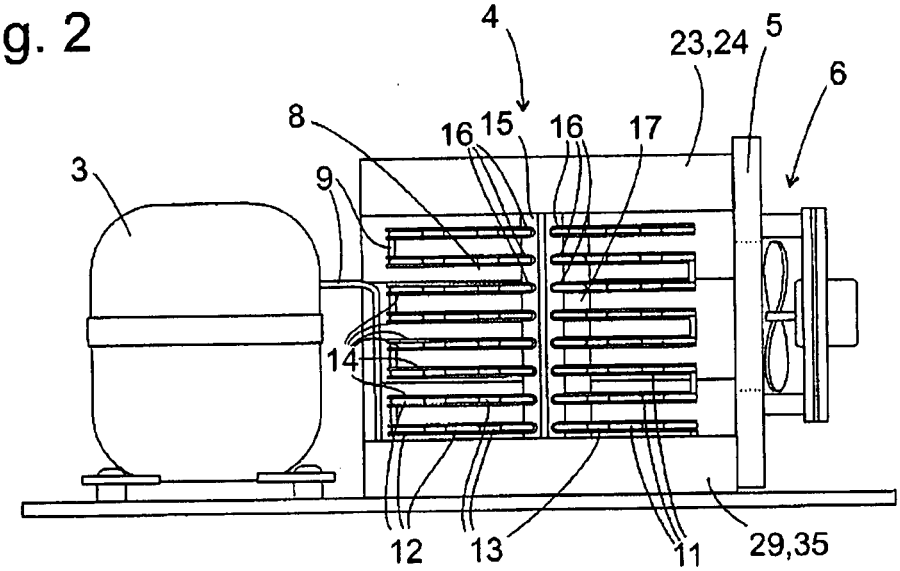
FIG. 2 shows a diagrammatic view of the condenser module of the refrigeration appliance from FIG. 1.
Figure 3:
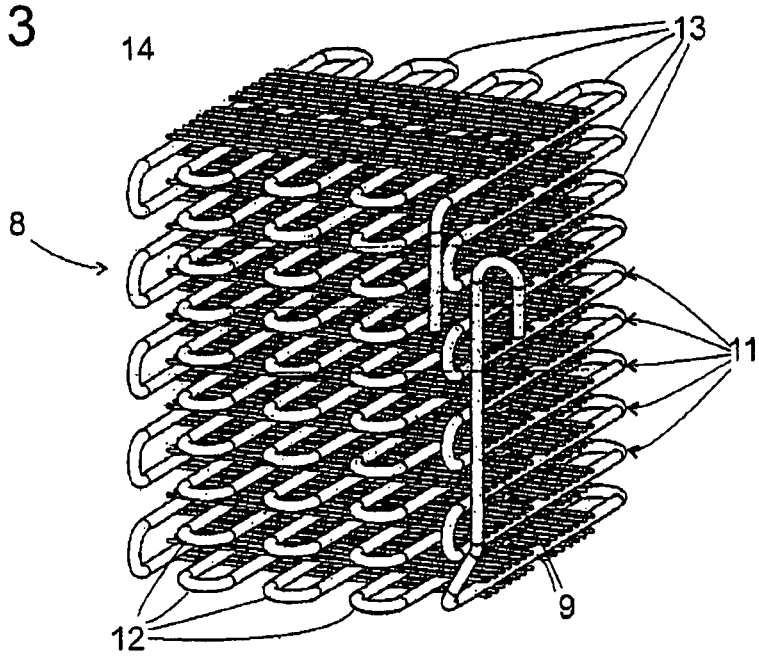
FIG. 3 shows a three-dimensional view of the condenser.

A view of the condenser module from the opposite direction, seen from the front in relation to the refrigeration appliance housing, is shown in FIG. 2. As is evident, the condenser housing 4 is open toward the front face of the appliance, and a wire tube condenser 8 can be seen in its interior. As is also apparent in the three-dimensional view of the condenser in FIG. 3, a refrigerant pipe 9 of the condenser 8 takes the form of a plurality of plate-type sections 11 arranged in parallel and one above the other, in which straight pipe sections connected in each case by 180° bends 12, 13 extend parallel to the direction of view in FIG. 2. In a manner known per se, the plate-type sections 11 are stiffened by means of wires 14 soldered onto the straight pipe sections. A column-like stabilization element 15 engages, from the front and in each case between two frontal bends 12 of each plate-type section 11, in the plate-type sections 11, and is provided with a plurality of paired slits 16 arranged opposite to each other, into which parts of the adjacent bends 12 engage in each case. A corresponding stabilization element 17 engages in the plate-type sections 11 from the rear and between the rear bends 13.

Figure 4:
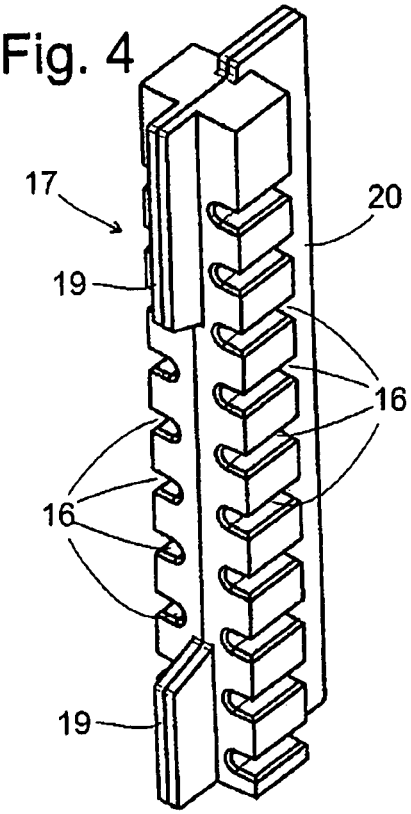
FIGS. 4, 5 in each case show three-dimensional views of stabilization elements of the condenser.
Figure 5:
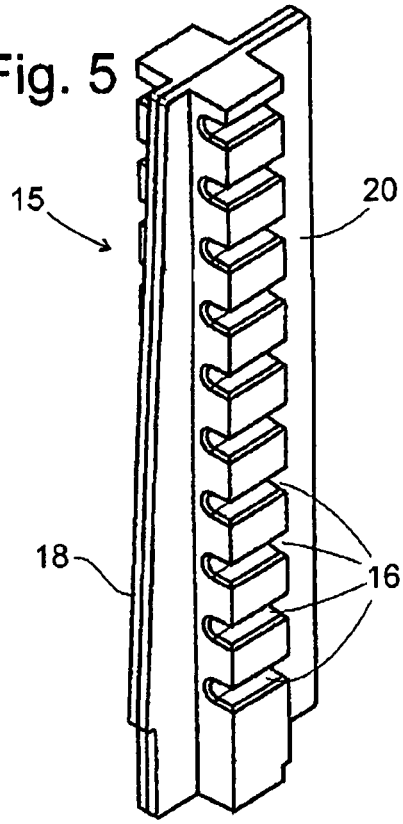

The stabilization elements 15, 17 are shown in FIGS. 4, 5, in each case in a three-dimensional view. They are hollow bodies made up of two trays joined along a vertical plane. On its exterior, the stabilization element 15 carries a vertical projection 18, which increases in width from top to bottom, so that the projection 18 locates firmly on the not completely vertical wall which divides the recess 1 from the internal compartment of the refrigeration appliance. The stabilization element 17 likewise bears a projection 19 directed outward and facing the side wall 7, which is interrupted in its middle section, in order to follow the contour of the side wall 7. Both stabilization elements 15, 17 have projections 20 located opposite to the projections 18 or 19 respectively, which engage in the wire tube condenser 8 and which reduce the free air throughput cross-section of the condenser 8, and concentrate a stream of air driven by the fan 6 in the center of the condenser 8.

Figure 6:
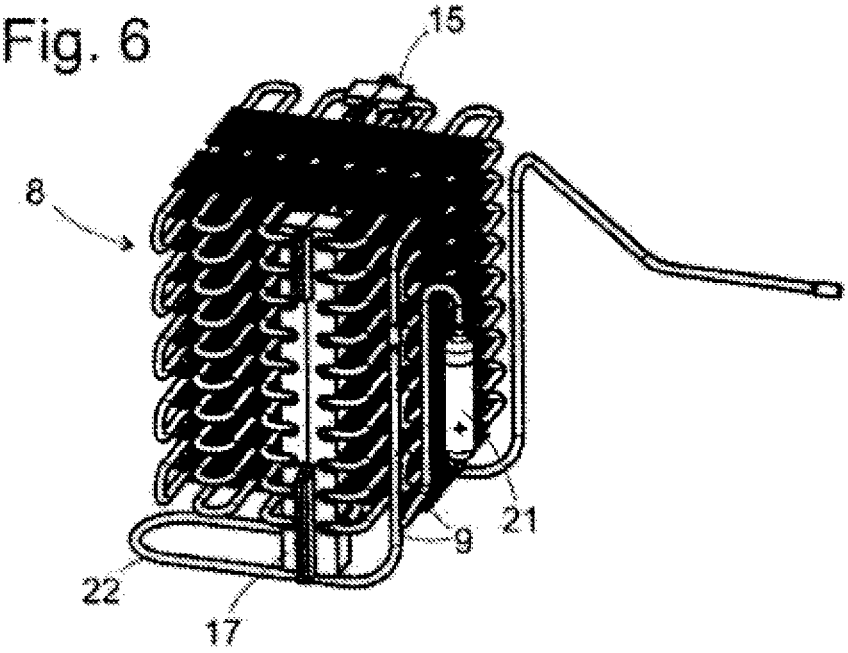
FIG. 6 shows the condenser in combination with the stabilization elements, a dryer and a heating loop for an evaporation tray.

FIG. 6 shows a three-dimensional view of the complete wire tube condenser 8, together with the stabilization elements 17, 19 inserted from the side. On one end of the tube 9 of the condenser 8 a dryer cartridge 21 is inserted in the path of the refrigerant, with the other end being elongated by means of a loop 22 extending underneath the condenser 8.

Figure 7:
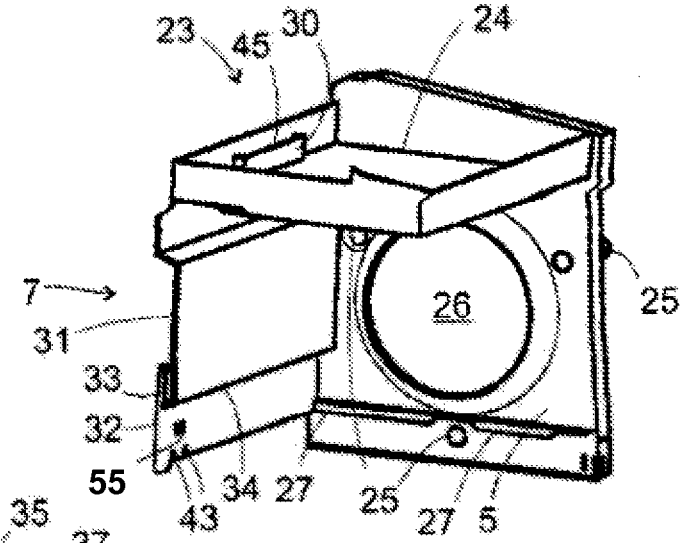
FIG. 7 shows a three-dimensional view of the upper part of a frame accommodating the condenser.
Figure 8:
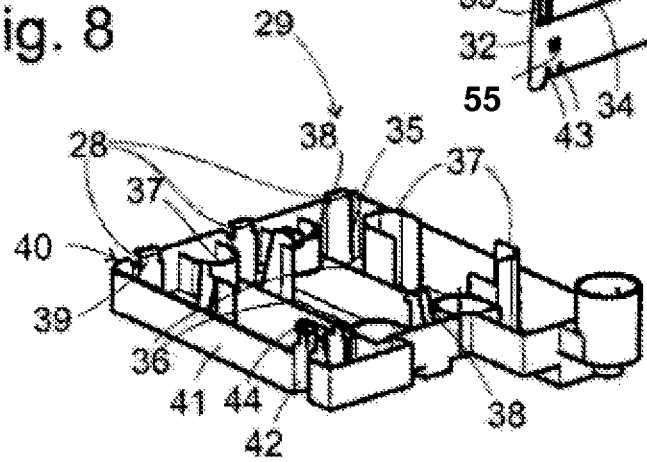
FIG. 8 shows a three-dimensional view of the lower part of the frame.

The housing 4 accommodating the condenser 8 is made up of two frames (e.g., plastic moldings) as shown in FIGS. 7 and 8 respectively. The upper frame (e.g., upper molding) 23 shown in FIG. 7 comprises the front wall 5, the side wall 7 and a cover of the condenser housing 4, embodied as an evaporation tray 24. Hollow plugs 25 protruding in piece from the front wall 5 away from the observer serve to position the fan 6, which is not shown in FIG. 7, in front of a central opening 26 in the front wall 5. Below the opening 26, a horizontal rib 27 projects into the interior of the housing 4. Together with a complementary groove 28 of the lower frame (e.g., lower moldings) 29 shown in FIG. 8, the horizontal rib 27 serves to fix the height of the upper molding 23 relative to the lower frame (e.g., lower molding 29).

In the vicinity of the rear edge of the base of the evaporation tray 24 is an opening 45 surrounded by a wall 30. The wall 30, which is somewhat lower than the outer edge of the evaporation tray 24, defines an overflow water level of the tray 24. If condensate, which is fed into the tray 24 from the interior of the refrigeration appliance, rises above the upper edge of the wall, water flows through the opening 45 of the tray 24 and down the inner face of the side wall 7 facing the condenser 8 and heated by it. The side wall 7 has a middle section 31 projecting into the interior of the condenser housing 4, which at its lower edge is connected with a lower section 32 of the wall by means of a rising wall section 33. Water flowing down the side wall 7 thus cannot reach the lower section 32 of the side wall 7, so that the lower edge of the middle section 31 forms a drip edge 34, from which drops of water fall directly into an evaporation tray 35 formed by the lower frame (e.g., lower molding) 29.

The upper edges of two elongated ribs 36 projecting from the base of the evaporation tray 35 serve as a supporting surface for the wire tube condenser 8. Curved ribs 37, which are taller than the elongated ribs 36, serve as lateral stops which define the position of the wire tube condenser 8 in the horizontal direction. Two hooks 38 are provided in order to engage behind pipe sections of the lowest plate-type section 11 of the wire tube condenser 8, thus fixing this to the lower evaporation tray 35. The shape and placement of ribs 36, 37 are in each case selected such that they permit location of the loop 22 in the vicinity of the base of the evaporation tray 35.

The horizontal groove 28 already mentioned is formed by a plurality of hooks 39 which are directed outward, on a front wall 40 of the tray 35 facing away from the observer in FIG. 8. An external wall 41 of the tray facing toward the observer has a recess 42, the walls of which, when assembled, engage in two grooves 43 of the lower section 32 of the side wall 7, thus supporting the upper frame (e.g., upper moldings) 23. A hook 44 embodied on the external wall 41 at the same height as the recess 42 is provided in order to engage in an opening 55 of the lower section 32 and thus latch the two frames (e.g., moldings) 23, 29 together.

The invention claimed is:

1. A condenser module for a refrigeration appliance, the condenser module comprising:

a frame;

a condenser arranged on the frame, the condenser being configured for a flow of a refrigerant therethrough; and a plurality of evaporation trays including at least an upper evaporation tray supported via the frame above the condenser and a lower evaporation tray supported via the frame below the condenser, wherein the upper evaporation tray has an overflow via which water passes from the upper evaporation tray into the lower evaporation tray, the frame having a side wall extending between the upper evaporation tray and the lower evaporation tray, the side wall having a surface facing the condenser, wherein the overflow cooperates with the surface of the side wall to form a flow path guiding water from the overflow across the surface of the side wall and into the lower evaporation tray, the side wall conducting a stream of air through the condenser.

2. The condenser module as claimed in claim 1, wherein a drip edge lying above the lower evaporation tray forms a portion of the flow path on the side wall.

3. The condenser module as claimed in claim 1, wherein the condenser is connected in series with a refrigerant line running through at least one of the evaporation trays.

4. The condenser module as claimed in claim 1, wherein at least the lower evaporation tray has a latching element for locking engagement with the condenser.

5. The condenser module as claimed in claim 1, wherein the upper evaporation tray is held in a releasable and removable manner on a structure connected to the lower evaporation tray.

6. The condenser module as claimed in claim 1, wherein the frame has a front wall with an opening in which is arranged an impeller of a fan.

7. The condenser module as claimed in claim 6, wherein the opening in the front wall is configured with a nozzle geometry having a portion with a first cross section and another portion with a relatively smaller cross section and positioned intermediate the portion with the first cross section and the condenser.

8. The condenser module as claimed in claim 6, wherein the impeller of the fan is disposed in the opening in the front wall.

9. The condenser module of claim 1, wherein the side wall includes a drip edge disposed above the lower evaporation tray, the drip edge preventing the water from flowing down the side wall beyond the drip edge, and the drip edge forming part of the flow path for guiding the water from the upper evaporation tray into the lower evaporation tray.

10. The condenser module as claimed in claim 1, wherein the condenser is a wire tube condenser with a plurality of heat exchanger elements, which are connected in series and arranged to form a plurality of planes.

11. The condenser module of claim 10, further comprising:

a first stabilization element for stabilizing the plurality of heat exchanger elements, the first stabilization element including means for abutting a portion of the side wall and preventing the stream of air through the condenser from flowing between a portion of the first stabilization element and a portion of the side wall.

12. The condenser module of claim 11, further comprising:

a second stabilization element for stabilizing the plurality of heat exchanger elements, the second stabilization element including second means for abutting a portion of a recess of a refrigeration appliance and preventing the stream of air through the condenser from flowing between a portion of the first stabilization element and a portion of the side wall.

13. The condenser module of claim 10, further comprising:

a first stabilization element for stabilizing the plurality of heat exchanger elements, the first stabilization element including a first projection abutting a portion of the side wall and preventing the stream of air through the condenser from flowing between a portion of the first stabilization element and a portion of the side wall.

14. The condenser module of claim 13, wherein the first projection has a contour matching a contour of the portion of the side wall.

15. The condenser module as claimed in claim 10, wherein the condenser includes a first stabilization element with a plurality of grooves, and wherein each respective edge of the plurality of heat exchanger elements in each of the plurality of planes engages in a respective groove of the plurality of grooves of the first stabilization element.

16. The condenser module as claimed in claim 15, wherein the plurality of heat exchanger elements are arranged one above another.

17. The condenser module as claimed in claim 16, wherein the first stabilization element is a columnar stabilization element having a face either touching the side wall of the frame or projecting into a recess of the refrigeration appliance accommodating the condenser module therein.

18. The condenser module as claimed in claim 16, wherein the first stabilization element includes pairs of grooves lying opposite one another and at the same height with respect to one another, wherein sections of piping of each heat exchanger element engage in a pair of grooves.

19. The condenser module as claimed in claim 16, wherein the condenser includes a second stabilization element, and wherein the first stabilization element and the second stabilization element are on opposite sides of the condenser.

20. The condenser module as claimed in claim 16, wherein the first stabilization element is formed from foamed plastic that is one of a plastic that is a foamed polystyrene and a plastic that is not a foamed polystyrene.

21. A refrigeration appliance comprising:

a compartment for retaining an item to be cooled; and a condenser module having a frame, a condenser arranged on the frame, the condenser being configured for a flow of a refrigerant therethrough, and a plurality of evaporation trays including at least an upper evaporation tray supported via the frame above the condenser and a lower evaporation tray supported via the frame below the condenser, wherein the upper evaporation tray has an overflow via which water passes from the upper evaporation tray into the lower evaporation tray, the frame having a side wall extending between the upper evaporation tray and the lower evaporation tray, the side wall having a surface facing the condenser, wherein the overflow cooperates with the surface of the side wall to form a flow path guiding water from the overflow across the surface of the side wall and into the lower evaporation tray, the side wall conducting a stream of air through the condenser.

22. The refrigeration appliance as claimed in claim 21 further comprising damping elements, wherein the condenser module is secured in a compressor recess on a rear wall of the refrigeration appliance and the damping elements are located between the condenser module and the refrigeration appliance for assisting with securement of the condenser module in position.

* * * * *

UNITED STATES PATENT AND TRADEMARK OFFICE

CERTIFICATE OF CORRECTION

PATENT NO. : 8,418,492 B2
APPLICATION NO. : 12/519826
DATED : April 16, 2013
INVENTOR(S) : Cieslik et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 969 days.

Signed and Sealed this
First Day of September, 2015

Michelle K. Lee

Michelle K. Lee
*Director of the United States Patent and Trademark Office*